United States Patent [19]

Kinder

[11] Patent Number: 4,928,929

[45] Date of Patent: May 29, 1990

[54] CONSTRUCTION SAFETY NETTING

[76] Inventor: Jay Kinder, 37 - 10 Lenox Dr., P.O. Box 2635, Fair Lawn, N.J. 07410

[21] Appl. No.: 152,626

[22] Filed: Feb. 5, 1988

[51] Int. Cl.[5] ..... E04H 17/16

[52] U.S. Cl. ..... 256/24; 256/23; 256/73

[58] Field of Search ..... 256/DIG. 6, 12.5, 24, 256/23, 73; 52/DIG. 12, 673, 675, 670; 273/29 B, 30, 181 F; 182/138

[56] References Cited

U.S. PATENT DOCUMENTS

| | | | |
|---|---|---|---|
| 516,858 | 8/1894 | Cleather et al. . | |
| 986,269 | 3/1911 | Cowell . | |
| 1,385,321 | 11/1964 | Irion . | |
| 1,476,853 | 12/1923 | Tabor | 256/1 |
| 1,566,945 | 12/1925 | Winkley | 273/181 F |
| 1,618,739 | 2/1927 | Wenzin | 256/1 X |
| 2,241,338 | 5/1941 | Balduf . | |
| 2,823,034 | 2/1958 | Bingham, Jr. . | |
| 2,997,277 | 8/1961 | Schwartz . | |
| 3,305,221 | 2/1967 | Kling . | |
| 3,338,290 | 8/1967 | Servis . | |
| 3,392,801 | 7/1968 | Gethmann . | |
| 3,480,257 | 1/1968 | Bourn et al. . | |
| 3,863,899 | 2/1975 | Werner . | |
| 3,933,311 | 1/1976 | Lemelson . | |
| 3,949,834 | 4/1976 | Nusbaum . | |
| 3,995,715 | 12/1976 | Virtanen . | |
| 4,119,176 | 10/1978 | Verdu . | |
| 4,124,196 | 11/1978 | Hipskind . | |
| 4,129,197 | 12/1978 | Preston . | |
| 4,236,698 | 12/1980 | Compte . | |
| 4,366,949 | 1/1983 | Staub, Sr. | 256/12.5 X |
| 4,523,760 | 6/1985 | Bednarczuk | 273/181 F |
| 4,574,534 | 3/1986 | Beaton . | |
| 4,732,234 | 3/1988 | Brickman . | |
| 4,738,335 | 4/1988 | Ishii . | |
| 4,815,562 | 3/1989 | Denny et al. . | |

FOREIGN PATENT DOCUMENTS 169887 12/1951 Austria .

OTHER PUBLICATIONS

"Promulgation of and Notice of Opportunity to Comment on Rules and Regulations Relating to Requiring Safety Netting During Construction Operations," Department of Buildings of the City of New York, pp. 1, 7 and 8, (circa May 1987).

*Primary Examiner*—Andrew V. Kundrat

*Attorney, Agent, or Firm*—Henry D. Coleman; R. Neil Sudol

[57] ABSTRACT

A safety netting for use at construction sites to prevent objects from falling from upper stories comprises a unitary web including a main portion provided with apertures to form a net-like lattice and a continuous bendable toeboard portion. The toeboard portion is bent along a longitudinally extending line to form an edge strip and a contiguous toeboard strip oriented at approximately a 90 degree angle with respect to one another. The edge strip is then attached to a horizontal floor surface, while the lattice portion of the netting is attached to pillars or other vertical supports at the construction site.

27 Claims, 1 Drawing Sheet

CONSTRUCTION SAFETY NETTING

BACKGROUND OF THE INVENTION

This invention relates to safety netting for use at construction sites.

In the construction of multistory buildings such as skyscrapers, it is necessary to install temporary vertical safety barriers at the edges of the various floors to prevent tools and construction materials such as rods, bricks, pipes and nails from falling from the floors and endangering people and property on underlying levels, including the ground surface. Such safety barriers generally include a toeboard in the form of a plywood strip which is fastened to a floor surface at the edge of the floor. A separate net element such as a fabric netting or lattice is attached to the toeboard at the construction site, as well as to upright supports such as vertical support beams or posts of the building superstructure. The toeboard serves to prevent nails and other small items from being kicked or swept off of a building floor, while the lattice or net functions to catch larger objects such as tools and bricks from falling from the upper stories of the building during construction.

An object of the present invention is to provide a vertical construction safety netting which is easily and quickly installed.

Another object of the present invention is to provide such a construction safety netting which is simple to manufacture and easy to transport.

Another, more particular, object of the present invention is to provide such a construction safety netting which is installed in less time than is required to install conventional vertical safety barriers at construction sites.

Another particular object of the present invention is to provide such construction safety netting which can be installed with the use of fewer tools than are required for the installation of conventional safety barriers.

SUMMARY OF THE INVENTION

Construction safety netting comprises, in accordance with the present invention, a flexible unitary web having a main portion provided with an array of apertures to form a lattice and a continuous toeboard portion bendable along a longitudinal line to form an edge strip and a toeboard strip, the toeboard portion being integral with the main portion. Preferably, the apertures are substantially rectangular and aligned in rows and columns to form a net-like lattice.

Pursuant to another feature of the present invention, the main portion of the construction safety netting is at least several feet in width and the toeboard portion is at least about four inches in width. Preferably, the main portion of the netting is approximately 4½ feet in width and the toeboard portion is approximately 7 to 7½ inches in width. The web is advantageously composed of high density polyethylene.

The main web or lattice portion of the construction safety netting serves the dual function of preventing motion of large objects such as tools past the safety netting and permitting the passage of air to reduce wind force. The toeboard portion performs the dual function of enabling the attachment of the netting to a floor at a construction site and preventing motion of small objects past a base portion of the safety netting in an installed state thereof.

A method for enhancing safety at a construction site comprises, in accordance with the present invention, the steps of (a) providing a safety netting in the form of a flexible unitary web with a main portion having an array of apertures to form a lattice and a continuous toeboard portion integral with the main portion, and (b) attaching the safety netting to the construction site, the step of attaching including the step of fastening the toeboard portion to a horizontal surface such as a floor or ground at the construction site.

Pursuant to a further feature of the present invention, the toeboard portion is bent along a longitudinally extending line to form from the toeboard portion an edge strip and a toeboard strip oriented at an angle with respect to one another, the step of fastening including the fastening of the edge strip to the floor or ground at the construction site. Generally, the safety netting takes the form of a roll of material, a segment of the web being severed along a transverse line prior to the step of bending.

Vertical construction safety netting in accordance with the present invention is easily and quickly installed. It can be installed in less time and with fewer tools than are required to install conventional vertical safety barriers at construction sites. Conventional construction techniques require that a fabric netting or fencing be attached to a plywood strip and that the plywood strip in turn be fastened to a floor surface. In contrast, the instant invention provides a vertical safety netting which includes an integral toeboard of the same material as the lattice, preferably high density polyethylene, the toeboard being sufficiently flexible so that it can be bent along a line prior to an attachment operation.

A construction safety netting in accordance with the present invention is simple to manufacture and easily coiled into rolls for transport.

DETAILED DESCRIPTION

Figure 1:
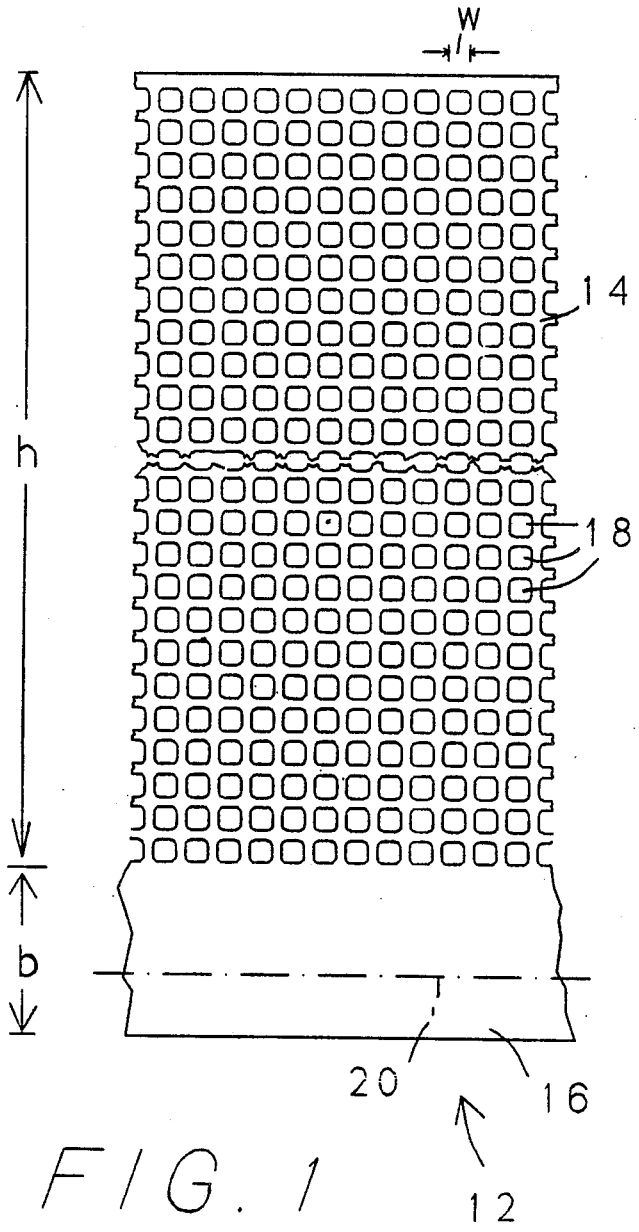
FIG. 1 is a partial front elevational view of a construction safety netting in accordance with the present invention.

As illustrated in FIG. 1, a vertical construction safety netting in accordance with the present invention comprises a flexible or bendable unitary web 12 of extruded high density polyethylene. The web includes a main portion 14 which has a height or width h of at least several feet and preferably approximately 4½ feet and a toeboard portion 16 which has a height or width b of at least approximately four and preferably 7 to 7½ inches. Main portion 14 is provided with an array of apertures 18, while toeboard portion 16 is a unperforated continuous piece integral with main portion 14. Pursuant to the present invention, it is particularly important that toeboard portion 16 is sufficiently flexible to enable a bending (i.e., deformation) of the toeboard portion along a longitudinally extending line 20 to form an edge strip 22 and a toeboard strip 24 (see FIG. 4) oriented at an angle of approximately 90 degrees with respect to one another. This flexibility is attainable when the high density polyethylene of toeboard 14 has a thickness of approximately 1/32 inch or less. As described in detail hereinafter with reference to FIG. 4, the bending of toeboard portion 16 along line 20 enables the attachment of the toeboard portion, specifically edge strip 22, to a horizontal surface 32 at a construction site so that the remaining part of the safety netting, i.e., toeboard strip 24 and main portion 14, is disposed in an upright position.

Figure 2:
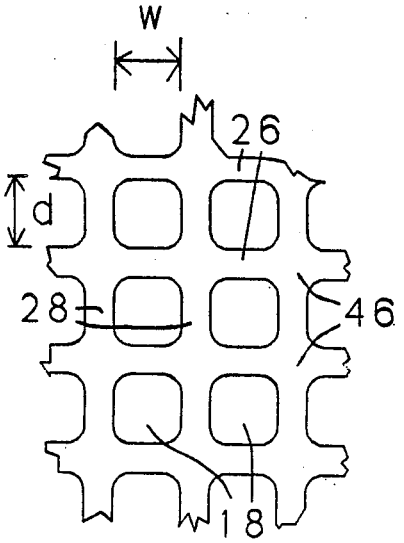
FIG. 2 is a front elevational view, on an enlarged scale, of a portion of the construction safety netting of FIG. 1.

As best seen in FIG. 2, apertures 18 are substantially rectangular and aligned in rows and columns to form a net-like lattice. Preferably, apertures 18 are approximately one inch in length on a side. Most preferably, apertures 18 have a height or depth d of approximately $\frac{7}{8}$ inch and a width w of approximately $1\frac{1}{8}$ inch. Each aperture 18 is defined by a first pair of opposing strips 26 and a second pair of opposing strips 28 oriented substantially orthogonally with respect to the first pair of strips 26.

Strips 26 and 28 of main portion or lattice 14 have a tensile strength at least sufficient to prevent motion of objects such as tools, bricks and other large construction materials past the safety netting at low to moderate speeds. In addition, the size and density of apertures 18 are sufficient to permit the passage of air to reduce the force of the wind on the safety netting.

Figure 3:
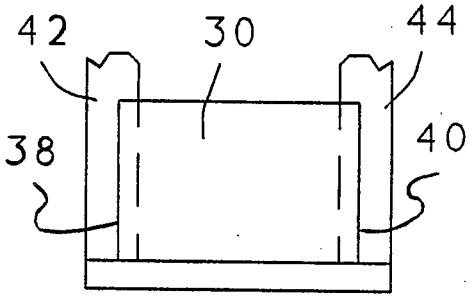
FIG. 3 is a schematic front elevational view of the construction safety netting of FIG. 1, on a reduced scale, showing attachment of the netting at a construction site.

To install construction safety netting in accordance with the present invention at a construction site, a segment 30 (see FIG. 3) may be severed from a roll of the netting along a transverse line extending perpendicularly to line 20 (FIG. 1). Toeboard portion 16 is then bent along line 20 and edge strip 22 is attached to horizontal upper surface 32 of a floor 34 by a plurality of tacks, nails or other fasteners 36 which perforate edge strip 22 during a fastening operation and which are spaced from one another along the length of edge strip 22. Vertically extending edges 38 and 40 of netting segment 30 are then attached by conventional means to posts or pillars 42 and 44 at the construction site.

Figure 4:
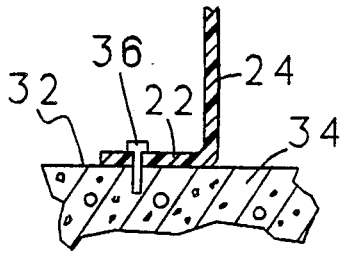
FIG. 4 is a partial cross-sectional view of the attached netting of FIG. 3.

As illustrated in FIG. 4, toeboard portion 16 serves to enable the attachment of the netting to a floor at a construction site and to prevent motion of small objects such as nails (e.g., during a floor sweeping operation) past a base portion of the safety netting in an installed state thereof.

A construction safety netting in accordance with the present invention can be manufactured by any technique known in the art. Specifically, techniques for producing unitary plastic snow fencing having a lattice structure similar to main portion 14 may be utilized. A particularly advantageous method of manufacture, well known in the art, involves the formation of opposing strips 28 (FIG. 2) by a stretching process so that strips 26 are thinner than strips 28 and accordingly have an enhanced tensile strength. The stretching process may include localized heating of vertical strips 28 in the regions of intersection points 46. Toeboard 16 is also thinner than vertical strips 28 and may similarly be formed upon the application of heat.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. Construction safety netting comprising an elongate flexible unitary web having a main portion with a width of at least several feet, said main portion being provided with an array of apertures to form a lattice, said web also having a continuous toeboard portion bendable along a longitudinal line to form an edge strip and a toeboard strip, said toeboard portion being integral with said main portion, said toeboard portion having a width of at least four inches.

2. The construction safety netting defined in claim 1 wherein said main portion is approximately $4\frac{1}{2}$ feet in width and said toeboard portion is 7 to $7\frac{1}{2}$ inches in width.

3. The construction safety netting defined in claim 1 wherein said web is extruded high density polyethylene.

4. The construction safety netting defined in claim 1 wherein said apertures are substantially rectangular and aligned in rows and columns to form a net-like lattice.

5. A method for enhancing safety at a construction site, said method comprising the steps of:

providing a safety netting in the form of a flexible unitary web with a main portion having an array of apertures to form a lattice and a continuous bendable toeboard portion integral with said main portion;

bending said toeboard portion along a longitudinally extending line to form from said toeboard portion an edge strip and a toeboard strip oriented at an angle with respect to one another; and attaching said safety netting to the construction site, said step of attaching including the step of fastening said edge strip to a horizontal surface at said construction site to prevent construction materials from passing underneath the safety netting.

6. The method defined in claim 5 wherein said step of fastening includes the step of perforating said edge strip at spaced intervals with fastener elements.

7. Construction safety netting comprising a flexible web in turn comprising:

a main portion provided with an array of apertures to form a lattice; and a secondary portion including a substantially continuous toeboard strip integral with said main portion, said secondary portion further including means for attaching the netting to a substantially horizontal surface along said toeboard strip, at an edge thereof opposite said main portion, so that said toeboard portion is substantially contiguous with the horizontal surface to prevent small objects from passing along the horizontal surface beyond the safety netting.

8. The construction safety netting defined in claim 7 wherein said toeboard strip is bendable along a longitudinal line to form an edge strip portion, said edge strip portion constituting part of said means for attaching the netting.

9. The construction safety netting defined in claim 8 wherein said main portion is at least several feet in width and said toeboard strip is at least approximately four inches in width.

10. The construction safety netting defined in claim 2 wherein said main portion is approximately $4\frac{1}{2}$ feed in width and said toeboard strip is 7 to $7\frac{1}{2}$ inches in width.

11. The construction safety netting defined in claim 9 wherein said web is extruded high density polyethylene.

12. The construction safety netting defined in claim 11 wherein said apertures are substantially rectangular and aligned in rows and columns to form a net-like lattice.

13. The construction safety netting defined in claim 8 wherein said apertures are substantially rectangular and aligned in rows and columns to form a net-like lattice.

14. Construction safety netting comprising a flexible web including:

first means for preventing motion of large objects past the safety netting and for permitting the passage of air to reduce wind force, said first means including a main web portion provided with an array of apertures to form a lattice; and second means for preventing motion of small objects past a base portion of the safety netting in an installed state thereof, said second means including a toeboard portion in the form of a continuous solid band of material attached to said main web portion and further including means for attaching the netting to a substantially horizontal surface along said toeboard portion, at an edge thereof opposite said main portion, so that said toeboard portion is substantially contiguous with the horizontal surface.

15. The construction safety netting defined in claim 14 wherein said toeboard portion is integral with said main portion.

16. The construction safety netting defined in claim 14 wherein said toeboard portion is bendable along a longitudinal line to form an edge strip and a toeboard strip, said edge strip constituting at least in part said means for attaching the netting.

17. The construction safety netting defined in claim 16 wherein said main web portion is several feet in width and said toeboard portion is at least approximately four inches in width.

18. The construction safety netting defined in claim 17 wherein said main portion is approximately 4½ feet in width and said toeboard portion is 7 to 7½ inches in width.

19. The construction safety netting defined in claim 17 wherein said web is extruded high density polyethylene.

20. The construction safety netting defined in claim 16 wherein said apertures are substantially rectangular and aligned in rows and columns to form a net-like lattice.

21. A method for enhancing safety at a construction site, said method comprising the steps of:

providing a safety netting in the form of a flexible web with a main portion having an array of apertures to form a lattice and a secondary portion including a toeboard strip in the form of a continuous solid band of material integral with said main portion; and attaching said safety netting to the construction site, said step of attaching including the step of fastening said toeboard strip to a substantially horizontal surface at the construction site to prevent construction materials from passing underneath the safety netting.

22. A method for enhancing safety at a construction site, said method comprising the steps of:

providing a safety netting in the form of a flexible unitary web with a main portion having an array of apertures to form a lattice and a continuous bendable toeboard portion integral with said main portion;

bending said toeboard portion along a longitudinally extending line to form from said toeboard portion an edge strip and a toeboard strip oriented at an angle with respect to one another; and attaching said safety netting to the construction site, said step of attaching including the step of fastening said edge strip to a horizontal surface at said construction site to prevent construction materials from passing underneath the safety netting, said step of fastening in turn including the step of perforating said edge strip at spaced intervals with fastener elements.

23. A method for enhancing safety at a construction site, said method comprising the steps of:

providing a safety netting in the form of a flexible web with a main portion having an array of apertures to form a lattice and a secondary portion including a substantially continuous toeboard strip attached to said main portion;

severing a segment of said web along a transverse line; and attaching a severed segment of said web to the construction site, said step of attaching including the step of fastening a toeboard portion of said severed segment to a substantially horizontal surface at the construction site to prevent construction materials from passing underneath the safety netting.

24. The method defined in claim 23 wherein said toeboard strip is integral with said main portion.

25. The method defined in claim 23, further comprising the step of bending the toeboard portion of said severed segment along a longitudinally extending line to form from said toeboard portion an edge strip and a toeboard strip oriented at an angle with respect to one another, said step of fastening including the fastening of said edge strip to the horizontal surface at said construction site.

26. The method defined in claim 25 wherein said step of severing is performed prior to said step of bending.

27. The method for enhancing safety at a construction site, said method comprising the steps of:

providing a safety netting in the form of a flexible web with a main portion having an array of apertures to form a lattice and a secondary portion including a substantially continuous toeboard strip attached to said main portion; and attaching said safety netting to the construction site, said step of attaching including the step of fastening said toeboard strip to a substantially horizontal surface at the construction site to prevent construction materials from passing underneath the safety netting, said step of fastening in turn including the step of perforating said toeboard at spaced intervals with fastener elements.

* * * * *